US008549668B1

(12) United States Patent
Anderes, Jr. et al.

(10) Patent No.: US 8,549,668 B1
(45) Date of Patent: Oct. 8, 2013

(54) GLOVE WITH ABRASION-RESISTANT ELEMENTS

(76) Inventors: John H. Anderes, Jr., Red Wing, MN (US); Jamie Wornson, Des Moines, IA (US)

( * ) Notice: Subject to any disclaimer, the term of this patent is extended or adjusted under 35 U.S.C. 154(b) by 136 days.

(21) Appl. No.: 12/208,583

(22) Filed: Sep. 11, 2008

Related U.S. Application Data

(60) Provisional application No. 60/971,362, filed on Sep. 11, 2007.

(51) Int. Cl.
*A41D 19/00* (2006.01)

(52) U.S. Cl.
USPC ..... 2/161.6; 2/163; 2/169

(58) Field of Classification Search
USPC ..... 2/161.6, 169, 163
See application file for complete search history.

(56) References Cited

U.S. PATENT DOCUMENTS 745,088 A 11/1903 Winkler
3,235,881 A * 2/1966 Chisholm ..... 2/167
4,094,014 A * 6/1978 Schroeder ..... 2/161.8
4,507,807 A 4/1985 Karkanen ..... 2/161 R
4,559,646 A 12/1985 Ertl ..... 2/16
4,766,612 A * 8/1988 Patton, Sr. ..... 2/16
4,774,727 A 10/1988 Jackson ..... 2/161 R
4,881,276 A * 11/1989 Swan ..... 2/161.1
4,995,119 A 2/1991 Codkind ..... 2/163
5,661,853 A 9/1997 Wilmot ..... 2/163
D393,336 S 4/1998 Zadworney, Jr. et al. ..... D2/619
5,774,895 A * 7/1998 Baldwin ..... 2/161.1
5,794,266 A * 8/1998 Han ..... 2/159
5,901,378 A 5/1999 Kirsch ..... 2/163
5,991,926 A 11/1999 Lakusiewicz ..... 2/168
6,061,830 A * 5/2000 Geller ..... 2/69
6,912,731 B2 * 7/2005 Cass ..... 2/161.1
6,981,283 B2 * 1/2006 Kujawski ..... 2/161.6
7,107,623 B2 * 9/2006 Hatch et al. ..... 2/161.5
2004/0025226 A1 * 2/2004 Jaeger ..... 2/161.6
2004/0091504 A1 5/2004 Hamann ..... 424/195.17
2007/0006363 A1 * 1/2007 Kim ..... 2/159

* cited by examiner

*Primary Examiner* — Katherine Moran
(74) *Attorney, Agent, or Firm* — Steven M. Koehler; Westman, Champlin & Kelley, P.A.

(57) ABSTRACT

A glove is disclosed that includes abrasion-resistant finger elements on the inner surface of the glove, including in the finger stalls. The finger elements include abrasion-resistant elements that define extended channels between them. The finger elements are composed of an abrasion-resistant material.

21 Claims, 2 Drawing Sheets

GLOVE WITH ABRASION-RESISTANT ELEMENTS

CROSS-REFERENCE TO RELATED APPLICATION

This application claims benefit of, and incorporates in its entirety by reference herein, provisional patent application No. 60/971,362, entitled GLOVE WITH ABRASION RESISTANT FEATURES, filed on Sep. 11, 2007.

BACKGROUND

The discussion below is merely provided for general background information and is not intended to be used as an aid in determining the scope of the claimed subject matter.

This disclosure pertains to gloves. Gloves are sometimes prone to abrasion, which can sometimes cause gloves to become worn out. It is generally desired to prevent gloves from becoming worn out.

SUMMARY

This Summary and Abstract are provided to introduce some concepts in a simplified faun that are further described below in the Detailed Description. This Summary and Abstract are not intended to identify key elements or essential elements of the claimed subject matter, nor are they intended to be used as an aid in determining the scope of the claimed subject matter. In addition, the description herein provided and the claimed subject matter should not be interpreted as being directed to addressing any of the short-comings discussed in the Background.

One aspect of the invention is to abate, minimize or eliminate wear due to contact on the inside of the glove by applying a flexible yet abrasion resistant material or solution to the inside of a portion of the glove, for instance, the finger area. This can be done using several different types of materials or solutions ranging from rubber to PVC (polyvinyl chloride), silicon, various forms of resins, or what ever other material or solution, or combinations thereof, that can accomplish this goal.

DETAILED DESCRIPTION

Figure 1:
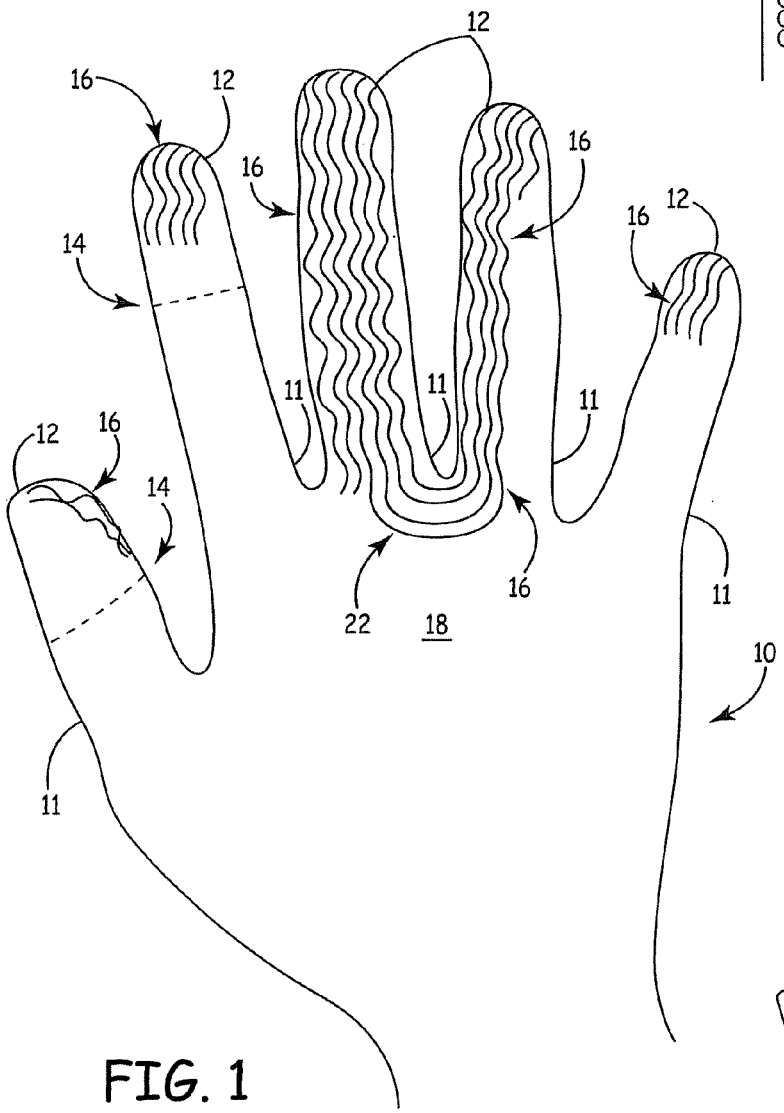
FIG. 1 depicts a glove with abrasion-resistant elements, according to an illustrative embodiment.

FIG. 1 depicts a glove 10 with abrasion-resistant elements 12, according to an illustrative embodiment. In this depiction, the glove 10 is turned inside-out, so that the inner surface thereof is seen, along with elements disposed on the inner surface. The outer surface of glove 10 may also have a similar positioning of the elements, and may also correspond to the depiction of FIG. 1.

Abrasion of a glove may be caused at least in part by abrasive or otherwise damaging contact from inside the glove and directed outwardly against the inner surface of the glove, in addition to abrasive or other harmful contact from outside the glove against the outer surface thereof. For example, abrasion from inside the glove may be caused by the wearer's fingernails wearing against the inner surface of the glove. This may be particularly relevant when the wearer is a woman with longer fingernails, for example. Such abrasion against the inner surface from within the glove may be addressed with an abrasion-resistant inner surface portions 12 such as those illustratively depicted in FIG. 1.

More particularly, glove 10 includes a glove body that is shaped to conformingly fit a wearer's hand. The glove body includes a central body portion 18 and a plurality of finger stalls 14. The central body portion 18 is shaped to conformingly fit over the wearer's palm and backside of the hand, while each of the finger stalls 14 is shaped to conformingly fit over a finger. One or more abrasion-resistant elements 16 are disposed on an inner surface of the glove body, i.e. the surface depicted in FIG. 1. As used herein, "abrasion-resistant", or similar variants thereof, means a material, compound and/or substance, etc. that inhibits abrasion of the material that it is proximate to.

Hence, the abrasion-resistant elements inhibit or reduce wearing of the glove material proximate the abrasion-resistant elements 16.

In one embodiment, the abrasion-resistant elements 16 can be embodied as wavy lines in FIG. 1. Furthermore, each of the abrasion-resistant elements 16 can be raised (relative to the proximate surface of the glove material) so that each would contact the skin and fingernails of a wearer's hand and fingers. The raised abrasion-resistant elements may further contribute to inhibiting wear of the proximate material of the glove 10, such as from a wearer's fingernails. The abrasion-resistant elements define extended channels of glove material between them, which may contribute to assuring air circulation about the wearer's skin to aid, for example, in evaporation, and/or to allow air circulation through the glove material, and/or as contributing to the insulation provided by the glove 10, which benefits may also be dependent upon the material(s) chosen for the glove.

Figure 2:
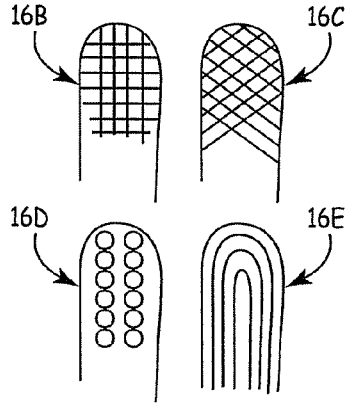
FIG. 2 depicts various abrasion-resistant finger elements, according to an illustrative embodiment.
Figure 3:
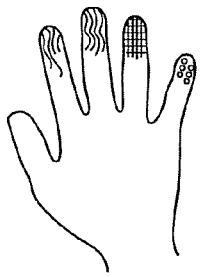
FIG. 3 depicts a glove with abrasion-resistant elements, according to another illustrative embodiment.

While the abrasion-resistant elements are illustratively embodied as wavy lines in FIG. 1, FIG. 2 illustratively depicts an exemplary sampling of some additional embodiments of the abrasion-resistant elements, each of which may or may not be raised. Any of the types of abrasion-resistant elements depicted in FIG. 2, or any other patterns of abrasion-resistant elements, or any combination thereof, may be used in various embodiments analogous to glove 10 and within the scope of the present disclosure. As illustratively depicted in FIG. 2, the abrasion-resistant elements may be embodied as grid-shaped segments 16B, criss-crossed segments 16C, circular segments 16D, or spaced-apart line segments and curved segments 16E. The abrasion-resistant elements may also be embodied as wavy segments 16 as in FIG. 1, or elliptical segments, or any combination of these illustrative examples (as depicted in FIG. 3) and/or any other patterns of abrasion-resistant elements, in different embodiments. The spaced-apart arrangements of these other embodiments also have one or more of the advantages discussed above.

The abrasion-resistant elements 16 may be composed of an abrasion-resistant material, illustratively such as rubber, silicone, polyvinyl chloride (PVC) and other types of plastics, and resin, or any combination of these and/or other materials, for example. Any other material that is recognized as having a significant resistance to abrasion may also be used in various embodiments.

Each of the finger stalls 14 of glove 10 defines a proximate end 11, proximate to the central body portion 18, and a distal end 12, distal to the central body portion 18, in the illustrative embodiment of FIG. 1. One or more portions of the abrasion-resistant elements 16 may be disposed on the inner surface at the distal end 12 of one or more of the finger stalls 14, as illustratively depicted in FIG. 1.

The abrasion-resistant elements 16 may also be contiguously connected among the inner surface of one or more of the finger stalls 14 and/or of the central body portion 18. For example, in one illustrative embodiment, the abrasion-resistant liner may extend along a portion of a finger stall from a position corresponding to the fingertip to a position corresponding to the last knuckle of the finger. In another illustrative embodiment, the abrasion-resistant liner may extend along a portion of a finger stall from a position corresponding to the fingertip, along the entire length of the finger stall, around all or part of its cross-sectional circumference, on a front and/or backside portions or both of a finger stall, to the central body portion of the glove, and optionally in contiguous connection with other liner portions extending to other portions of the glove.

This may include on a front part of the central body portion 18 that is configured to conformingly fit over a wearer's palm, and/or a back part of the central body portion 18 that is configured to conformingly fit over the backside of a wearer's hand, for example. For example, in the illustrative embodiment of FIG. 1, abrasion-resistant liner portion 22 contiguously connects liner portions that extend along certain of the finger stalls 14 of the glove, i.e. those configured to fit over the middle finger and ring finger as depicted. Abrasion-resistant liner portion 22 also contiguously connects these liner portions in these finger stalls with a liner portion that covers a portion of the inner surface in the central body portion where it is configured to fit over the wearer's palm and/or the backside of the wearer's hand, in this illustrative embodiment.

The abrasion-resistant elements may be disposed on the inside of the glove on positions configured to fit over part or all of any or all of the fingers and/or thumb, the palm, the backside of the hand, and any other part of the hand and/or portions thereof.

Various aspects disclosed herein may be applied to all forms and varieties of gloves. For example, they may be applied with some gloves that are manufactured from individual pieces of material with or without side pieces that are attached together, by stitching, gluing, or some other technique. They may also be applied with some gloves that have a front piece and a back piece thereof formed from a single piece of material, such as wherein the material is continuous over the tip of each of the finger stalls of the glove.

The abrasion-resistant elements may be applied to the material of the glove prior to assembly, or after assembly of the pieces of materials into a unitary glove. In an illustrative embodiment, screen printing techniques may be used for any or all pieces of the glove where protection is desired. For instance, if the glove is made from a single piece that includes the front and back piece of the glove, a continuous abrasion-resistant liner portion may be formed over the tip of each of the finger stalls configured to fit over the thumb and each of the other four fingers. Abrasion-resistant elements may be applied to gloves composed of any type of material, illustratively including but not limited to leather, synthetic leather, cotton, synthetic fabric, wool, fleece, and material that is woven or smooth.

In an illustrative embodiment, a single piece of material forms a continuous front and back side of the finger stalls of a glove, and abrasion-resistant elements may be used both on the inner surface and the outer surface of the finger stalls. The liner on the outer surface of the finger stalls may include abrasion-resistant elements, which may illustratively be embodied as long unbroken straight or wavy lines or curves or segments or lines or curves, that define extended channels among them. The lines or curves may be oriented along the length of the finger stalls, such that individual lines or curves may extend unbroken from a position on the palm of the glove, along the length of the finger stall, over the fingertip, and onto the opposite side of the finger stall. In one illustrative embodiment, one or more lines or line segments may extend unbroken at least over the distal tip 12 of a finger stall (with reference to FIG. 1) to a position corresponding to proximate any of the knuckles of the fingers of a wearer. The lines or segments may extend across any combination of positions or portions of the finger stalls, central body portion, or other portions of the glove. The use of continuous lines or line segments may contribute to ensuring that the abrasion-resistant material occupies a solid portion of the outer surface of the glove and contributes to resisting abrasion, in some embodiments. The extended channels defined among the abrasion-resistant elements may also contribute to maintaining breathability in the glove.

Figure 5:
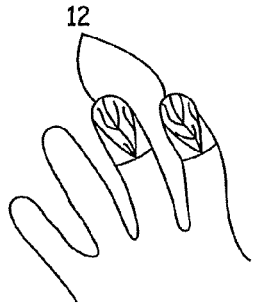
FIG. 5 depicts a glove with abrasion-resistant elements, according to an illustrative embodiment.
Figure 6:
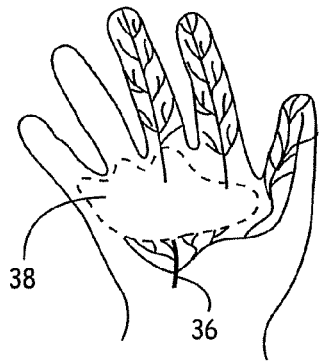
FIG. 6 depicts a glove with abrasion-resistant elements, according to an illustrative embodiment.
Figure 4:
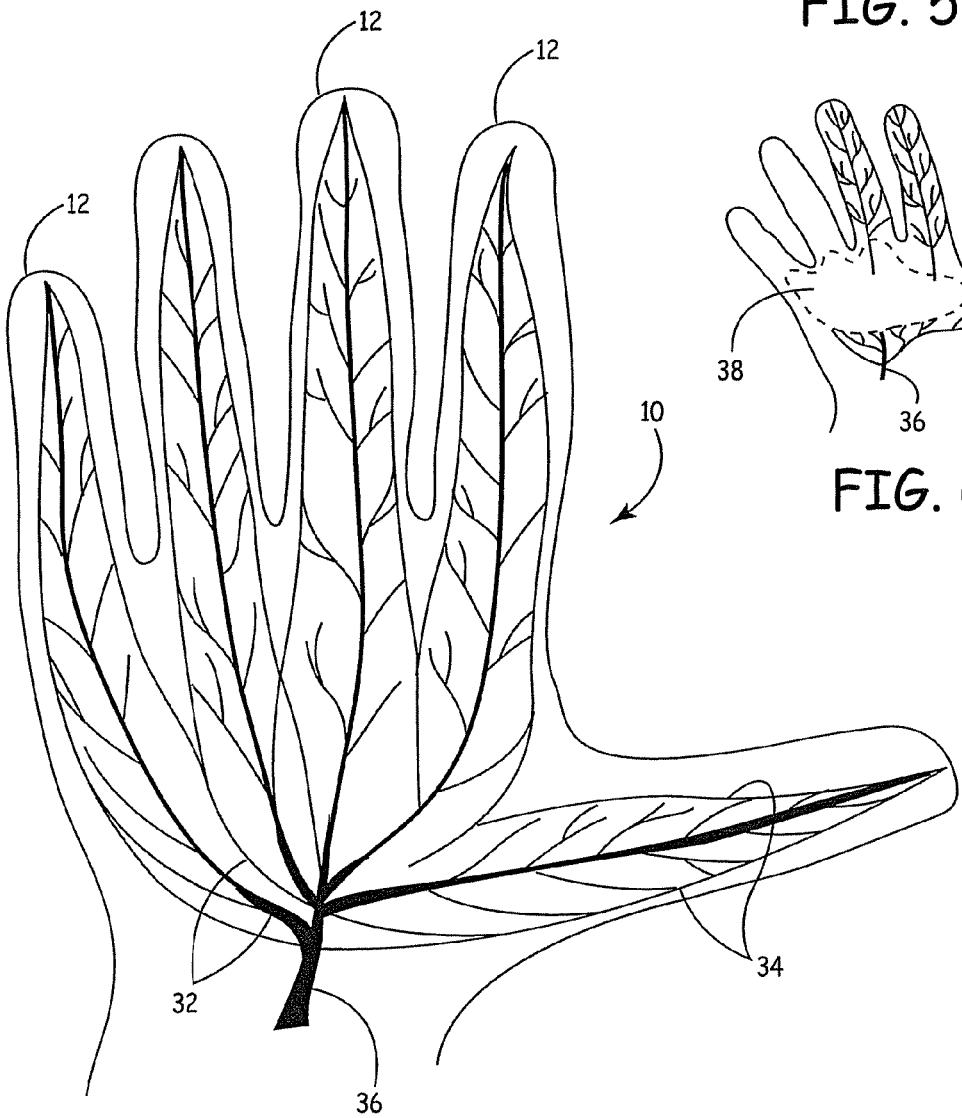
FIG. 4 depicts a glove with abrasion-resistant elements, according to an illustrative embodiment.

FIGS. 4, 5, and 6 depict additional illustrative embodiments of gloves with abrasion-resistant elements in accordance with the present disclosure. In various embodiments, at least one of the one or more elements disposed on the outer surface of the glove body may be formed in a design that forms a representative depiction of a natural object. In different embodiments, the abrasion-resistant elements may be formed in a representative depiction of an aspect of a natural object. For example, as illustratively depicted in FIG. 4, the glove comprises an abrasion-resistant liner formed in a design that forms a representative depiction of a leaf 30. In this illustrative embodiment, the abrasion-resistant elements may be formed in a representative depiction of veins 32 of a leaf, stem 36 of the leaf, and the perimeter 34 defining the shape of the leaf, as illustratively depicted in FIG. 4. Portions of the leaf 30 may be positioned on the central body portion of the glove, and extend along the finger stalls 12 of the glove and over the distal ends thereof, as depicted in FIG. 5. This design may combine an aesthetically pleasing appearance, which may contribute to the function of generating interest and attracting purchases of the gloves, with advantages in usage, such as contributing to both durability and breathability of the abrasion-resistant elements. As illustratively depicted in FIG. 6, a pad may also be attached to an outer surface of a glove, in another illustrative embodiment. An example of one pad suitable for use on a glove is sold by Liquicell Technologies, Inc. of Eden Prairie, Minn. In combination with a design pattern such as a leaf, the pad may cover a portion of the pattern, as illustratively depicted in FIG. 6, or the pattern may also be imposed over the surface of the pad, in another embodiment.

Although the subject matter has been described in language specific to certain compositions, structural elements and/or methodological acts, it is to be understood that the subject matter defined in the appended claims is not necessarily limited to the specific compositions, elements or acts described above as has been determined by the courts. Rather, the specific compositions, elements and acts described above are disclosed as example forms of implementing the claims.

What is claimed is:

1. A glove comprising:

a glove body shaped to conformingly fit a hand, the glove body comprising a central body portion and a plurality of finger stalls, each of the finger stalls being longitudinally oriented from a proximate end, proximate to the central body portion, and a distal end, distal to the central body portion, each finger stall having an inner surface and an outer surface, the inner surface made of a material and facing inwardly to form a cavity shaped to conformingly cover a finger of a user; and a plurality of abrasion-resistant elements joined to the inner surface at the distal end of each of the finger stalls so as to contact a fingertip of each finger of a wearer's hand when each of said fingers is inserted in the cavity of each corresponding finger stall, the abrasion-resistant elements being spaced apart and defining channels between them longitudinally oriented with respect to each finger stall, the abrasion-resistant elements being made of a flexible material that is different than the material of the inner surface.

2. The glove of claim 1, wherein one or more additional elements of abrasion-resistant material are on a part of an inner surface of a second cavity of the central body portion that is configured to conformingly fit over and face a palm of the user.

3. The glove of claim 2, wherein one or more of the additional elements are connected to one or more of the plurality of abrasion resistant elements, the abrasion resistant material thereby extending along the inner surface of the second cavity and along one or more of the inner surfaces of the cavities of one or more of the finger stalls to the distal end thereof, and further extending over a portion of the distal end configured to conformingly fit over a fingertip, and further extending onto a portion of the finger stall configured to conformingly fit over a backside of a finger.

4. The glove of claim 1, wherein one or more additional elements of abrasion-resistant material are also disposed at least in part on a part of the inner surface of a second cavity of the central body portion that is configured to conformingly fit over a backside of a wearer's hand.

5. The glove of claim 1, further comprising additional elements of abrasion-resistant material disposed on an outer surface of the glove body.

6. The glove of claim 5, wherein at least one of the additional elements disposed on the outer surface of the glove body form a representative depiction of a natural object.

7. The glove of claim 6, wherein the representative depiction comprises veins.

8. The glove of claim 1, wherein the abrasion-resistant material is composed at least in part from one or more materials selected from among rubber, silicone, polyvinyl chloride, and resin.

9. The glove of claim 1, further comprising a pad attached to an outer surface thereof.

10. The glove of claim 1 wherein the abrasion-resistant material remains secured to the inner surface of each respective cavity in a continuous form in the spaced apart arrangement when the material forming the cavity is turned inside-out such that the inner surface faces outwardly.

11. The glove of claim 10 wherein a first portion of the flexible abrasion-resistant material is disposed on the inner surface of each cavity that faces a fingernail of the user when the finger is disposed in the cavity, a second portion of the flexible abrasion-resistant material being further disposed on the inner surface of the cavity so as to face a tip of the finger when the finger is disposed in the cavity, and a third portion of the flexible abrasion-resistant material being disposed on the inner surface of the cavity so as to face the first portion of abrasion-resistant material, and wherein each portion of the abrasion-resistant material remains secured to the inner surface of each of the cavities in a continuous form when material forming each of the cavities is turned inside-out such that the inner surface faces outwardly.

12. A glove comprising:

a glove body shaped to conformingly fit a hand, the glove body comprising a central body portion and a plurality of finger stalls, each of the finger stalls being longitudinally oriented from a proximate end, proximate to the central body portion, and a distal end, distal to the central body portion, each finger stall having an inner surface and an outer surface, the inner surface made of a material and facing inwardly to form a cavity shaped to conformingly cover a finger of a user; and a plurality of abrasion-resistant elements joined to the inner surface at the distal end of each of the finger stalls so as to contact a fingertip of each finger of a wearer's hand when each of said fingers is inserted in the cavity of each corresponding finger stall, the abrasion-resistant elements being formed in a pattern with spaces formed between portions thereof and being secured to the inner surface of each respective cavity so as to face and extend over a fingertip of a finger inserted in each respective cavity, the abrasion-resistant elements being made of a flexible material that is different than the material of the inner surface, and wherein the abrasion-resistant material remains secured to the inner surface of each respective cavity in the spaced apart arrangement when the material forming the cavity is turned inside-out such that the inner surface faces outwardly.

13. The glove of claim 12, wherein each of the abrasion-resistant elements comprises a pattern having a plurality of spaced-apart, unbroken line segments.

14. The glove of claim 12, wherein the abrasion-resistant elements form a single pattern of material.

15. The glove of claim 12, wherein the pattern comprises spaced apart line segments.

16. The glove of claim 12, wherein the pattern comprises spaced apart curved segments.

17. The glove of claim 12, wherein the pattern comprises criss-crossed segments.

18. The glove of claim 12, wherein the pattern comprises grid segments.

19. The glove of claim 12, wherein the pattern comprises circular segments.

20. The glove of claim 12, wherein the pattern comprises elliptical segments.

21. The glove of claim 12 wherein a first portion of the flexible abrasion-resistant material is disposed on the inner surface of each cavity that faces a fingernail of the user when the finger is disposed in the cavity, a second portion of the flexible abrasion-resistant material being further disposed on the inner surface of the cavity so as to face a tip of the finger when the finger is disposed in the cavity, and a third portion of the flexible abrasion-resistant material being disposed on the inner surface of the cavity so as to face the first portion of abrasion-resistant material, and wherein each portion of the abrasion-resistant material remains secured to the inner surface of each of the cavities in a continuous form when material forming each of the cavities is turned inside-out such that the inner surface faces outwardly.

* * * * *